US007878505B2

(12) United States Patent
Meier et al.

(10) Patent No.: US 7,878,505 B2
(45) Date of Patent: Feb. 1, 2011

(54) CREDENTIAL SUBSTRATE ROTATOR AND PROCESSING MODULE

(75) Inventors: James R. Meier, St. Paul, MN (US); Martin A. Pribula, Eden Prairie, MN (US); Stacy W. Lukaskawcez, Shakopee, MN (US); Chadwick M. Johnson, Savage, MN (US); Anthony L. Lokken, Eden Prairie, MN (US)

(73) Assignee: HID Global Corporation, Irvine, CA (US)

( * ) Notice: Subject to any disclaimer, the term of this patent is extended or adjusted under 35 U.S.C. 154(b) by 1217 days.

(21) Appl. No.: 11/222,505

(22) Filed: Sep. 8, 2005

(65) Prior Publication Data

US 2006/0071420 A1 Apr. 6, 2006

Related U.S. Application Data

(63) Continuation-in-part of application No. 11/135,619, filed on May 23, 2005, now Pat. No. 7,154,519, which is a continuation of application No. 10/647,666, filed on Aug. 25, 2003, now Pat. No. 7,344,325, and a continuation-in-part of application No. 10/647,798, filed on Aug. 25, 2003, now Pat. No. 7,018,117.

(60) Provisional application No. 60/607,880, filed on Sep. 8, 2004, provisional application No. 60/611,256, filed on Sep. 17, 2004, provisional application No. 60/497,009, filed on Aug. 19, 2003.

(51) Int. Cl.
*B65H 39/10* (2006.01)

(52) U.S. Cl. ..... 271/302; 271/300; 271/176; 271/298

(58) Field of Classification Search ..... 271/296, 271/298, 300, 302, 176, 265.01
See application file for complete search history.

(56) References Cited

U.S. PATENT DOCUMENTS 3,598,396 A 8/1971 Andrews et al. ..... 271/9

(Continued)

FOREIGN PATENT DOCUMENTS

DE 25 35 699 A1 3/1977

(Continued)

OTHER PUBLICATIONS

International Search Report and Written Opinion of International Application No. PCT/US05/31861 filed Sep. 8, 2005.

(Continued)

*Primary Examiner*—Stefanos Karmis
*Assistant Examiner*—Ernesto Suarez
(74) *Attorney, Agent, or Firm*—Westman, Champlin & Kelly, P.A.

(57) ABSTRACT

A credential substrate rotator includes a substrate support, a substrate feeder and a substrate sensor. The substrate support is configured to support a substrate in a substrate support plane and rotate about a central axis. The substrate feeder is configured to feed a substrate along the substrate support plane. The substrate sensor includes a substrate position indicator that is aligned with the central axis and has first and second positions. The first position indicates an absence of a substrate from a predetermined location of the substrate support. The second position indicates a presence of a substrate in the predetermined location of the substrate support. Also disclosed, is a credential substrate processing module that includes a credential substrate rotator, a first data encoder and a module controller. The credential substrate rotator includes a substrate support configured to support a substrate in a substrate support plane and rotate about a central axis, and a substrate feeder. The first data encoder is configured to encode data to a substrate presented by the substrate rotator.

25 Claims, 14 Drawing Sheets

U.S. PATENT DOCUMENTS

| | | | | | |
|---|---|---|---|---|---|
| 3,755,653 | A | | 8/1973 | Venker | 235/61.11 |
| 3,889,472 | A | | 6/1975 | Guillaud | 60/698 |
| 3,889,795 | A | | 6/1975 | Garberi et al. | 400/208 |
| 3,899,065 | A | | 8/1975 | Brignole | 400/208 |
| 3,960,072 | A | | 6/1976 | Ahlgren et al. | 101/35 |
| 4,015,839 | A | | 4/1977 | McKee | 271/37 |
| 4,017,068 | A | | 4/1977 | McKee | 271/275 |
| 4,031,518 | A | | 6/1977 | Holloran et al. | 340/172.5 |
| 4,068,028 | A | | 1/1978 | Samonides | 428/40 |
| 4,102,267 | A | | 7/1978 | Ritzerfeld | 101/132.5 |
| 4,146,900 | A | | 3/1979 | Arnold | 346/75 |
| 4,161,312 | A | | 7/1979 | Eckhardt et al. | 271/3 |
| 4,350,453 | A | | 9/1982 | Field et al. | 400/208 |
| 4,350,454 | A | | 9/1982 | Schoenlein | 400/234 |
| 4,393,386 | A | | 7/1983 | Di Giulio | 346/75 |
| 4,471,885 | A | | 9/1984 | Mucciarone | 221/155 |
| 4,534,313 | A | | 8/1985 | Louvel | 118/696 |
| 4,604,631 | A | | 8/1986 | Jinnai et al. | 346/1.1 |
| 4,673,304 | A | | 6/1987 | Liu et al. | 400/208 |
| 4,676,678 | A | | 6/1987 | Watanabe | 400/208 |
| 4,680,596 | A | | 7/1987 | Logan | 346/140 |
| 4,685,702 | A | | 8/1987 | Kazuharu | 283/81 |
| 4,686,540 | A | | 8/1987 | Leslie et al. | 346/33 |
| 4,687,358 | A | | 8/1987 | Saitou | 400/208 |
| 4,716,346 | A | | 12/1987 | Matsuo | 318/38 |
| 4,733,980 | A | | 3/1988 | Tosa | 400/207 |
| 4,734,868 | A | | 3/1988 | DeLacy | 364/519 |
| 4,781,985 | A | | 11/1988 | Desjarlais | 428/421 |
| 4,782,363 | A | | 11/1988 | Britt et al. | 355/14 |
| 4,797,018 | A | | 1/1989 | Hofmann et al. | 400/208 |
| 4,845,490 | A | | 7/1989 | Ward et al. | 340/825.31 |
| 4,848,941 | A | | 7/1989 | Imaseki | 406/120 |
| 4,961,088 | A | | 10/1990 | Gilliland et al. | 355/206 |
| 5,019,839 | A | | 5/1991 | Watanabe et al. | 346/134 |
| 5,037,216 | A | | 8/1991 | Nubson et al. | 400/120 |
| 5,077,467 | A | | 12/1991 | Barron, Jr. et al. | 250/221 |
| 5,079,565 | A | | 1/1992 | Shimizu et al. | 346/76 |
| 5,111,239 | A | | 5/1992 | Kamimura et al. | 355/45 |
| 5,128,763 | A | | 7/1992 | Sakuragi | 358/296 |
| 5,138,344 | A | | 8/1992 | Ujita | 400/175 |
| 5,149,211 | A | | 9/1992 | Pettigrew | 400/88 |
| 5,150,174 | A | | 9/1992 | Ryczek et al. | 356/402 |
| 5,184,181 | A | | 2/1993 | Kurando et al. | 355/260 |
| 5,239,926 | A | | 8/1993 | Nubson et al. | 101/487 |
| 5,266,781 | A | | 11/1993 | Warwick et al. | 235/375 |
| 5,266,968 | A | | 11/1993 | Stephenson | 400/208 |
| 5,267,800 | A | | 12/1993 | Petterutl et al. | 400/88 |
| 5,277,501 | A | | 1/1994 | Tanaka et al. | 400/120 |
| 5,318,369 | A | | 6/1994 | Ishii | 400/249 |
| 5,318,370 | A | | 6/1994 | Nehowig | 400/207 |
| 5,326,179 | A | | 7/1994 | Fukai et al. | 400/120 |
| 5,327,201 | A | | 7/1994 | Coleman et al. | 355/278 |
| 5,368,677 | A | | 11/1994 | Ueda et al. | 156/362 |
| 5,455,617 | A | | 10/1995 | Stephenson et al. | 400/207 |
| 5,466,319 | A | | 11/1995 | Zager et al. | 156/220 |
| 5,502,464 | A | | 3/1996 | Takahashi et al. | 346/25 |
| 5,516,218 | A | | 5/1996 | Amano et al. | 400/535 |
| 5,530,468 | A | | 6/1996 | Yoshimi et al. | 347/262 |
| 5,558,449 | A | | 9/1996 | Morgavi | 400/188 |
| 5,642,877 | A | | 7/1997 | Green | 271/35 |
| 5,646,388 | A | | 7/1997 | D'Entremont et al. | 235/380 |
| 5,694,849 | A | * | 12/1997 | Wehle et al. | 101/233 |
| 5,695,589 | A | | 12/1997 | German et al. | 156/250 |
| 5,703,347 | A | | 12/1997 | Reddersen et al. | 235/472 |
| 5,707,162 | A | | 1/1998 | Kasal et al. | 400/692 |
| 5,709,484 | A | * | 1/1998 | Dorner | 400/188 |
| 5,709,485 | A | | 1/1998 | Kohno | 400/208 |
| 5,751,330 | A | | 5/1998 | Austin et al. | 347/171 |
| 5,755,519 | A | | 5/1998 | Klinefelter | 400/249 |
| 5,771,058 | A | * | 6/1998 | Kobayashi | 347/218 |
| 5,772,199 | A | | 6/1998 | Green | 271/10.06 |
| 5,790,162 | A | | 8/1998 | Adams et al. | 347/222 |
| 5,820,281 | A | | 10/1998 | Hill et al. | 400/621 |
| 5,837,991 | A | | 11/1998 | LaManna et al. | 235/475 |
| 5,882,127 | A | | 3/1999 | Amano | 400/521 |
| 5,927,713 | A | * | 7/1999 | Driscoll et al. | 271/298 |
| 5,936,008 | A | | 8/1999 | Jones et al. | 523/161 |
| 5,941,522 | A | * | 8/1999 | Hagstrom et al. | 271/225 |
| 5,978,621 | A | | 11/1999 | Glemser et al. | 399/90 |
| 5,980,011 | A | | 11/1999 | Cummins et al. | 347/4 |
| 5,984,546 | A | | 11/1999 | Kameyama | 400/208 |
| 5,995,774 | A | | 11/1999 | Applegate et al. | 399/27 |
| 5,999,908 | A | | 12/1999 | Abelow | 705/1 |
| 6,011,741 | A | | 1/2000 | Wallace et al. | 365/221 |
| 6,011,948 | A | * | 1/2000 | Amano et al. | 399/395 |
| 6,037,879 | A | | 3/2000 | Tuttle | 340/825.54 |
| 6,039,430 | A | | 3/2000 | Helterline et al. | 347/19 |
| 6,071,024 | A | | 6/2000 | Chi-Ming et al. | 347/177 |
| 6,072,402 | A | | 6/2000 | Kniffin et al. | 340/825 |
| 6,076,913 | A | | 6/2000 | Garcia et al. | 347/19 |
| 6,099,101 | A | | 8/2000 | Maurelli et al. | 347/7 |
| 6,099,178 | A | | 8/2000 | Spurr et al. | 400/207 |
| 6,113,208 | A | | 9/2000 | Benjamin et al. | 347/7 |
| 6,163,658 | A | | 12/2000 | Suzuki | 399/12 |
| 6,179,401 | B1 | | 1/2001 | Stephens, Jr. et al. | 347/19 |
| 6,213,392 | B1 | | 4/2001 | Zuppicich | 235/380 |
| 6,236,420 | B1 | * | 5/2001 | Matsuzaka | 347/170 |
| 6,249,303 | B1 | * | 6/2001 | Mochizuki et al. | 347/222 |
| 6,252,791 | B1 | | 6/2001 | Wallace et al. | 365/221 |
| 6,253,329 | B1 | | 6/2001 | Kang | 713/300 |
| 6,263,170 | B1 | | 7/2001 | Bortnem | 399/13 |
| 6,264,296 | B1 | * | 7/2001 | Klinefelter et al. | 347/4 |
| 6,264,301 | B1 | | 7/2001 | Helterline et al. | 347/19 |
| 6,267,463 | B1 | | 7/2001 | Paulsen | 347/19 |
| 6,271,928 | B1 | | 8/2001 | Bullock et al. | 358/1.16 |
| 6,279,901 | B1 | * | 8/2001 | Fulmer | 271/272 |
| 6,286,828 | B1 | * | 9/2001 | Adema | 271/186 |
| 6,302,527 | B1 | | 10/2001 | Walker | 347/50 |
| 6,305,795 | B2 | | 10/2001 | Childers et al. | 347/86 |
| 6,312,083 | B1 | | 11/2001 | Moore | 347/19 |
| 6,312,106 | B1 | | 11/2001 | Walker | 347/50 |
| 6,318,914 | B1 | * | 11/2001 | Cuo et al. | 400/188 |
| 6,325,495 | B1 | | 12/2001 | Foth | 347/84 |
| 6,341,839 | B1 | | 1/2002 | Burikov et al. | 347/37 |
| 6,362,868 | B1 | | 3/2002 | Silverbrook | 355/18 |
| 6,371,586 | B1 | | 4/2002 | Saruta | 347/7 |
| 6,380,965 | B1 | | 4/2002 | Sims et al. | 347/218 |
| 6,386,772 | B1 | | 5/2002 | Klinefelter et al. | 400/208 |
| 6,405,055 | B1 | | 6/2002 | Silverbrook et al. | 455/556 |
| 6,412,991 | B1 | | 7/2002 | Klinefelter et al. | 400/240 |
| 6,428,132 | B1 | | 8/2002 | Kubatzki et al. | 347/7 |
| 6,464,317 | B2 | | 10/2002 | Miyazawa | 347/14 |
| 6,592,032 | B1 | | 7/2003 | Takaragi et al. | 235/382 |
| 6,631,967 | B1 | | 10/2003 | Saruta | 347/19 |
| 6,644,771 | B1 | | 11/2003 | Silverbrook | 347/19 |
| 6,650,351 | B2 | | 11/2003 | Yamamoto et al. | 347/214 |
| 6,694,884 | B2 | | 2/2004 | Klinefelter et al. | 101/484 |
| 6,722,649 | B2 | * | 4/2004 | Yui | 271/184 |
| 6,762,780 | B2 | | 7/2004 | Tsuruta et al. | 347/171 |
| 6,776,470 | B2 | | 8/2004 | Steinmetz et al. | 347/19 |
| 6,798,434 | B2 | | 9/2004 | Shibata et al. | 347/214 |
| 2001/0052923 | A1 | | 12/2001 | Suzuki | 347/217 |
| 2002/0118243 | A1 | | 8/2002 | Forman | 347/19 |
| 2002/0172537 | A1 | | 11/2002 | Hamisch, Jr. et al. | 400/191 |
| 2002/0180993 | A1 | | 12/2002 | Klinefelter et al. | 358/1.1 |
| 2003/0028766 | A1 | | 2/2003 | Gass et al. | 713/164 |
| 2003/0059050 | A1 | | 3/2003 | Hohberger et al. | 380/270 |
| 2003/0128269 | A1 | | 7/2003 | Squires et al. | 347/214 |
| 2003/0215274 | A1 | * | 11/2003 | Ahn | 399/388 |
| 2004/0022572 | A1 | | 2/2004 | Bungert et al. | 400/248 |
| 2004/0109715 | A1 | | 6/2004 | Meier et al. | 400/191 |
| 2004/0114981 | A1 | | 6/2004 | Meier et al. | 400/208 |
| 2004/0223011 | A1 | | 11/2004 | Adkins et al. | 347/7 |
| 2005/0019078 | A1 | | 1/2005 | Meier et al. | 400/76 |

2005/0084315 A1 4/2005 Lodwig et al. ..... 400/701

FOREIGN PATENT DOCUMENTS

| | | | |
|---|---|---|---|
| EP | 0 431 172 | A | 6/1991 |
| EP | 0 562 979 | | 9/1993 |
| EP | 0 887 197 | | 12/1998 |
| EP | 0 979 736 | | 2/2000 |
| EP | 1 095 783 | B1 | 12/2003 |
| FR | 2770174 | | 4/1999 |
| FR | 2770174 | A1 * | 4/1999 |
| GB | 2 120 821 | A | 12/1983 |
| JP | 404105948 | A | 4/1992 |
| JP | 411105359 | A | 4/1999 |
| JP | 11 265463 | | 9/1999 |
| JP | 2001039588 | | 2/2001 |
| JP | 02002120446 | A | 4/2002 |
| JP | 2003146510 | | 5/2003 |
| WO | WO 95/09084 | | 4/1995 |
| WO | WO 99/04368 | | 1/1999 |
| WO | WO 99/21713 | | 5/1999 |
| WO | 99/49379 | | 9/1999 |
| WO | WO 03/019459 | A3 | 3/2003 |
| WO | WO 2004/011268 | A1 | 2/2004 |
| WO | WO 2005/070687 | A2 | 8/2005 |

PUBLICATIONS

Office Communication for U.S. Appl. No. 10/647,666, filed Feb. 25, 2003. Date of Mailing: Apr. 13, 2006.

Extended European Search Report and European Search Opinion of European Patent Application No. 05803865.4 filed Sep. 8, 2005.

Examination Report of European Patent Application No. 05803865.4 filed Sep. 8, 2005.

U.S. Appl. No. 11/135,619, filed May 23, 2005.

Office Communication for U.S. Appl. No. 10/647,666, filed Aug. 25, 2003, date of mailing: Sep. 15, 2004.

U.S. Appl. No. 10/071,554, filed Feb. 8, 2003.

U.S. Appl. No. 60/497,009, filed Aug. 19, 2003.

"Standard Read/Write Identification IC", by TEMIC Semiconductor GmbH, Heilbronn, Germany, (Apr. 1999).

"Introducing the New SmartGuard™ and SmartShield™ Advanced Security Options", pamphlet by Fargo Electronics, Inc., Eden Prairie, Minnesota (1998).

"RFID Tagging IC is First to Accept Input from Sensors", by Microchip Technology Inc., (undated).

Two page web site advertisement from SEIKO Precision, entitled "The lastest design for your CD-R", re: CD Printer 2000.

Two page web site advertisement from SEIKO Precision, entitled "CD Printer 2000".

Two page web site advertisement from SEIKO Precision, entitled "CD Printer 4000".

Partial International Search for International Application No. PCT/US 01/17146, filed May 25, 2001 (with Invitation to Pay Fees).

International Search Report for International Application No. PCT/US 00/01697, filed Jan. 21, 2000, dated Oct. 18, 2000.

Streamfeeder—ST 1250 Universal Friction Feeder; last modified Feb. 27, 2000; 1 page with heading of "Streamfeeder—Product Index"; and 3 pages with heading of "Streamfeeder—ST 1250 Universal Friction Feeder".

* cited by examiner

CREDENTIAL SUBSTRATE ROTATOR AND PROCESSING MODULE

CROSS-REFERENCE TO RELATED APPLICATION

The present application is based on and claims the benefit of U.S. provisional patent application Ser. No. 60/607,880, filed Sep. 8, 2004, entitled "FLIPPER AND ENCODER MODULE", and U.S. provisional patent application Ser. No. 60/611,256, filed Sep. 17, 2004, entitled "IDENTIFICATION CARD FLIPPER AND ENCODER MODULE"; the present application is a continuation-in-part of U.S. application Ser. No. 11/135,619, filed May 23, 2005, entitled "PRINTER AND RIBBON CARTRIDGE," which in turn is a continuation of U.S. application Ser. No. 10/647,666, filed Aug. 23, 2003, entitled "IDENTIFICATION CARD PRINTER AND RIBBON CARTRIDGE", which claims the benefit of U.S. Provisional Application No. 60/497,009; and is a continuation-in-part of U.S. application Ser. No. 10/647,798, filed Aug. 25, 2003, entitled "IDENTIFICATION CARD PRINTER RIBBON CARTRIDGE". All of the above-referenced applications are hereby incorporated by reference in their entirety.

FIELD OF THE INVENTION

The present invention generally relates to credential substrate manufacturing and, more particularly, to a credential substrate rotator for rotating a credential substrate and a credential substrate processing module for use with a stand-alone credential manufacturing device to expand the substrate processing capabilities of the stand-alone device.

BACKGROUND OF THE INVENTION

Credentials include identification cards, driver's licenses, passports, and other documents. Such credentials are formed from credential substrates including paper substrates, plastic substrates, cards and other materials. Such credentials generally include printed information, such as a photo, account numbers, identification numbers, and other personal information. A secure overlaminate may also be laminated to the surfaces of the credential substrate to protect the surfaces from damage and, in some instances, provide a security feature (e.g., hologram). Additionally, credentials can include data that is encoded in a smartcard chip, a magnetic stripe, or a barcode, for example.

It is desirable to provide customers with affordable credential manufacturing devices that meet their particular needs. While most customers will desire a set of basic features, such as credential substrate printing, some clients will demand more features, such as a substrate flipping, encoding and laminating.

To that end, it is desirable to provide substrate rotating, encoding and/or other substrate processing functions in a modular or add-on device that can be attached to an existing stand-alone credential manufacturing device to expand its functionality. Such a modular system allows customers to customize their credential manufacturing system to their particular needs and avoid paying for unnecessary substrate processing functions.

Embodiments of the present invention provide solutions to these and other problems, and offer other advantages over the prior art.

SUMMARY OF THE INVENTION

The present invention is generally directed to credential substrate processing including substrate rotating and data encoding. One embodiment of the invention is directed to a substrate rotator that includes a substrate support, a substrate feeder and a substrate sensor. The substrate support is configured to support a substrate in a substrate support plane and rotate about a central axis. The substrate feeder is configured to feed a substrate along the substrate support plane. The substrate sensor includes a substrate position indicator that is aligned with the central axis and has first and second positions. The first position indicates an absence of a substrate from a predetermined location of the substrate support. The second position indicates a presence of a substrate in the predetermined location of the substrate support.

Another embodiment of the invention is directed to a credential substrate processing module that includes the substrate rotator described above.

Another embodiment of the invention is directed to a credential substrate processing module that includes a credential substrate rotator, a first data encoder and a module controller. The credential substrate rotator includes a substrate support and a substrate feeder. The substrate support is configured to support a substrate in a substrate support plane and rotate about a central axis. The substrate support includes indexed angular positions including a substrate receiving position, in which the substrate support is positioned to receive a substrate fed from an adjoining stand-alone credential manufacturing device, and a first encoding position. The first data encoder is configured to encode data to a substrate presented by the substrate rotator when the substrate support is oriented with the first encoding position. The module controller is configured to control the substrate rotator and the first encoder module and communicate with a controller of the stand-alone credential manufacturing device Other features and benefits that characterize embodiments of the present invention will be apparent upon reading the following detailed description and review of the associated drawings.

DETAILED DESCRIPTION OF ILLUSTRATIVE EMBODIMENTS

Figure 1:
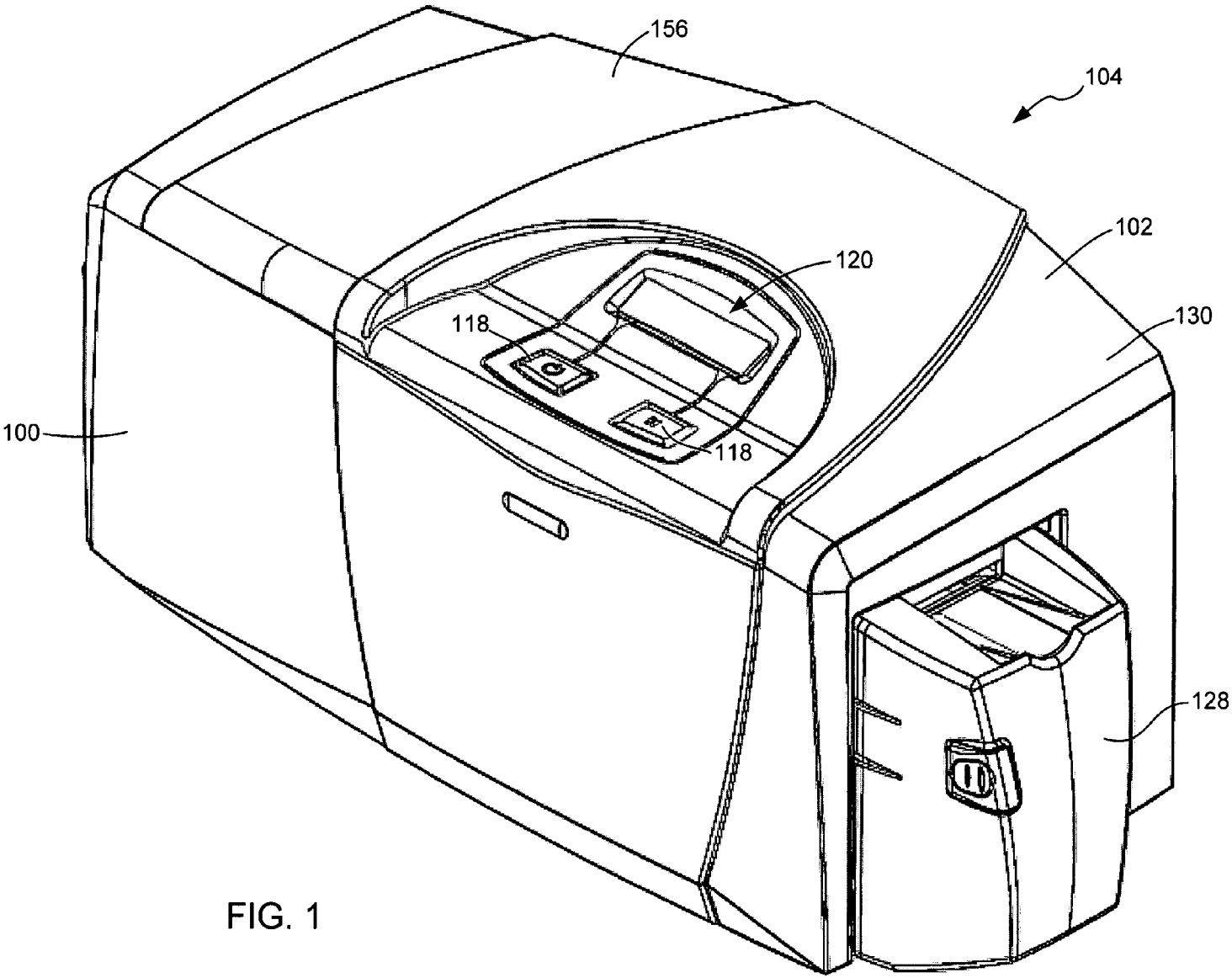
FIG. 1 is a perspective view of a credential manufacturing system in accordance with embodiments of the invention.
Figure 2:
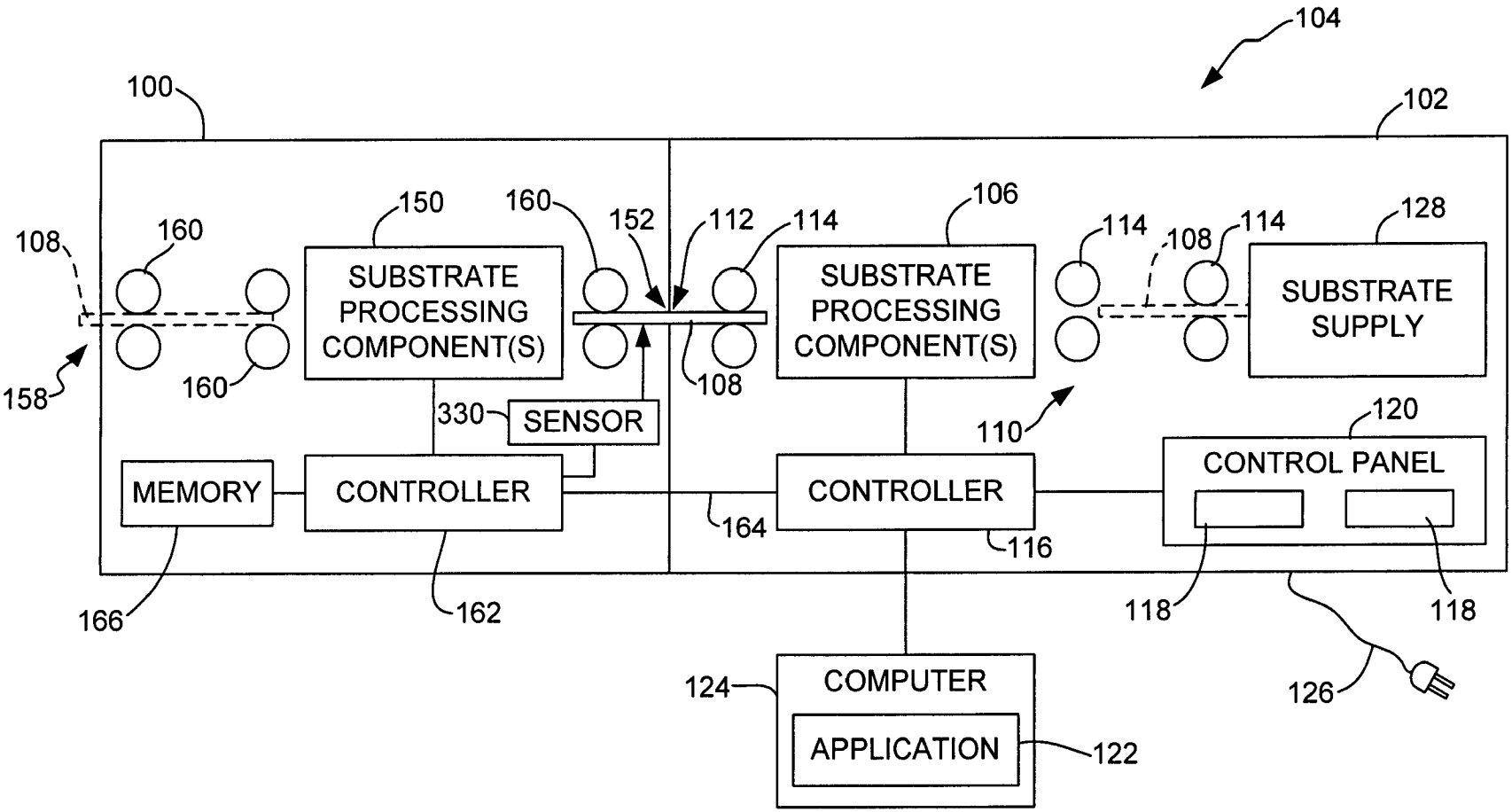
FIG. 2 is a schematic diagram of a credential manufacturing system in accordance with embodiments of the invention.

Embodiments of the present invention are generally related to a credential substrate processing module 100 (hereinafter "module") that attaches to a stand-alone credential manufacturing device (CMD) 102 to form a credential manufacturing system 104, as illustrated in the exploded perspective view of FIG. 1. FIG. 2 is a schematic diagram of the system 104 in accordance with several embodiments of the invention.

Although embodiments of the CMD 102 and module 100 of the present invention will be depicted as being operable with credential substrates that are generally in the form of card substrates, it should be understood that the CMD 102 and the module 100 can be configured for use with other types of credential substrates such as, for example, paper substrates, plastic substrates, substrates used to form passports, and other credential-related materials.

One advantage of the system 104 over more complex stand-alone credential manufacturing devices, is that the system 104 can be customized to the needs of a particular user. The ability to select only the features that are desired allows the user to avoid the cost of purchasing undesired or unnecessary credential processing functions.

In the event that additional functionality, over that provided by the stand-alone CMD 102 is desired, the user has the option of obtaining the module 100 and installing it in the field. Additionally, the module 100 itself can be updated with different credential substrate processing components.

Stand-Alone Credential Manufacturing Device

The stand-alone CMD 102 includes at least one credential substrate processing component 106, such as a printing device for printing to a surface of a credential substrate 108, a laminating device for laminating a surface of a credential substrate 108, and/or another credential substrate processing component. One suitable CMD 102 that includes a printing mechanism is described in U.S. application Ser. Nos. 11/135,619, 10/647,666 and 10/647,798, each of which are incorporated herein by reference in their entirety.

The term "stand-alone CMD" is intended to describe a CMD 102 that is configured for operation by itself while being configured for connection to the module 100. That is, the CMD 102 is configured to perform a credential processing function without the aid of the module 100, whereas the module 100 is generally configured for operation only with the CMD 102.

In addition to the at least one credential substrate processing component 106, the CMD 102 includes a substrate transport mechanism 110 for feeding the substrate 108 through the CMD 102 including presenting the substrate 108 to the substrate processing component 106 for processing and discharging the substrate 108 through a substrate output 112. The transport mechanism 110 can include, for example, motor-driven rollers including pinch roller assemblies, such as assemblies 114, or other substrate feeding components designed to feed the particular credential substrate 108 being processed.

A CMD controller 116 operates to control the operation of the CMD 102 including, for example, the processing mechanism 106 and the transport mechanism 110. The controller 116 can be accessed directly by a user through buttons 118 on a control panel 120 of the device 102, or through a credential production application and/or driver software 122 running on a computer 124.

Power is preferably supplied to the CMD through a cable 126 connected to a line level power outlet. Alternatively, power can be supplied to the CMD 102 from a battery or other power supply.

Several substrates 108 can be contained in a substrate supply 128 of the CMD 102, from which the substrate transport mechanism 110 can receive individual substrates 108 for feeding through the CMD 102. When operating as a stand-alone device (i.e., the module 100 is not attached), a hopper (not shown) can be positioned to collect substrates that are discharged through the substrate output 112. A housing section 130 (FIG. 1) covers the components of the CMD 102 including the substrate output end of the CMD 102 when it is operating as a stand-alone unit.

Substrate Processing Module

The module 100 is configured to couple to the CMD 102 and perform processing of credential substrates 108 received from the CMD 102 using at least one substrate processing component 150. In accordance with one embodiment of the invention, the module 100 is configured to be mounted to the CMD 102 such that a substrate input 152 of the module 100 is in substrate handoff alignment with the substrate output 112 of the CMD. When positioned in such substrate handoff alignment, substrates 108 can be fed between the substrate input 152 of the module 100 and the substrate output 112 of the CMD 102, as shown in FIG. 2.

In accordance with one embodiment of the invention, the module 100 includes brackets 154 (FIG. 3) that mate to the CMD 102 using screws or other suitable fasteners to mount the module 100 to the CMD 102 in substrate handoff alignment. The module 100 preferably includes a housing 156 that mates with the housing 130 of the CMD 102, as shown in FIG. 1. Thus, following the processing of a substrate 108 by the substrate processing component 150 of the module 100, the module 100 can pass the substrate 108 back to the CMD 102 through the substrate input 152 for additional processing by the substrate processing component 106, or discharge the substrate through a substrate output 158.

The at least one substrate processing component 150 can include a substrate rotator, one or more a data encoders, and/or other credential substrate processing components. Substrates 108 can be driven through the module 100 by substrate feeding components 160, such as drive and idler rollers and pinch roller pairs, or other substrate feeding components that are suitable for feeding the particular type of substrate 108 being processed.

In accordance with one embodiment of the invention, the module 100 includes a module controller 162 that can control the at least one substrate processing component 150 and the substrate feeding components 160 and is separate from the controller 116 of the CMD 102. At least one cable 164 (FIG. 2) connects the controllers 162 and 116 together to facilitate communication there between. Additionally, power can be supplied to the module 100 through the one or more cables 164.

The controllers 162 and 116 communicate with each other through the at least one cable 164 to synchronize substrate feeding operations, provide processing instructions in accordance with a credential processing job produced by the application and/or the driver software 122, and communicate other information useful in the processing of substrates 108.

In accordance with one embodiment of the module 100, the module controller 162 can access memory 166 (FIG. 2), in which firmware, default module settings, and other information can be stored. The controller 116 can also be provided access to the memory 166 and the module controller 162 can be provided access to memory of the CMD 102.

Substrate Rotator

Figure 4:
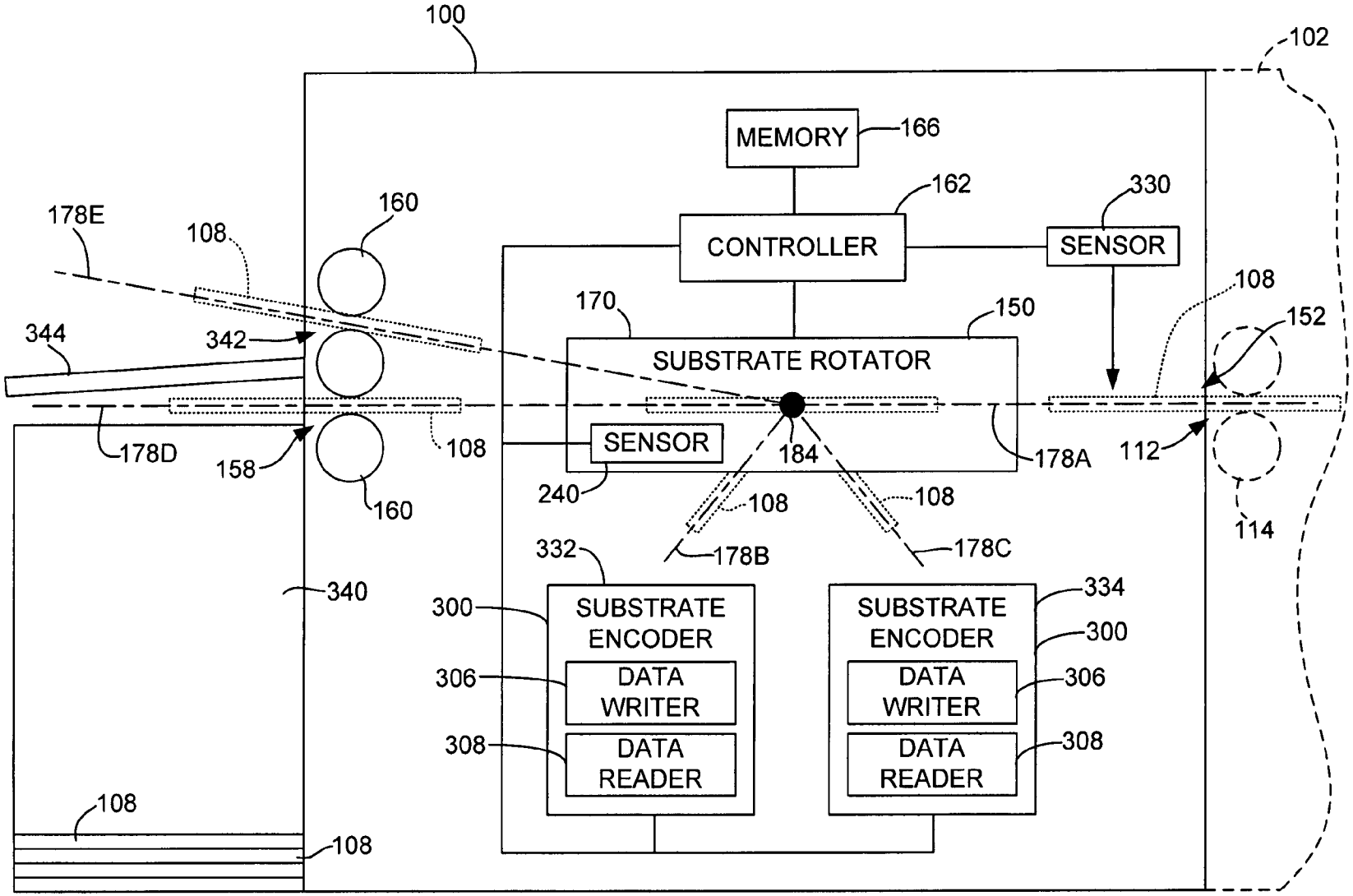
FIG. 4 is a schematic diagram of a credential substrate processing module in accordance with embodiments of the invention.

In accordance with one embodiment of the invention, the substrate processing component 150 of the module 100 includes a substrate rotator 170, shown schematically in FIG. 4. The substrate rotator 170 is configured to rotate a credential substrate 108 that is received from the CMD 102 to different angular positions. For example, the substrate rotator 170 can invert the substrate 108 then send the substrate 108 back to the stand-alone CMD 102 for additional processing.

Figure 5:
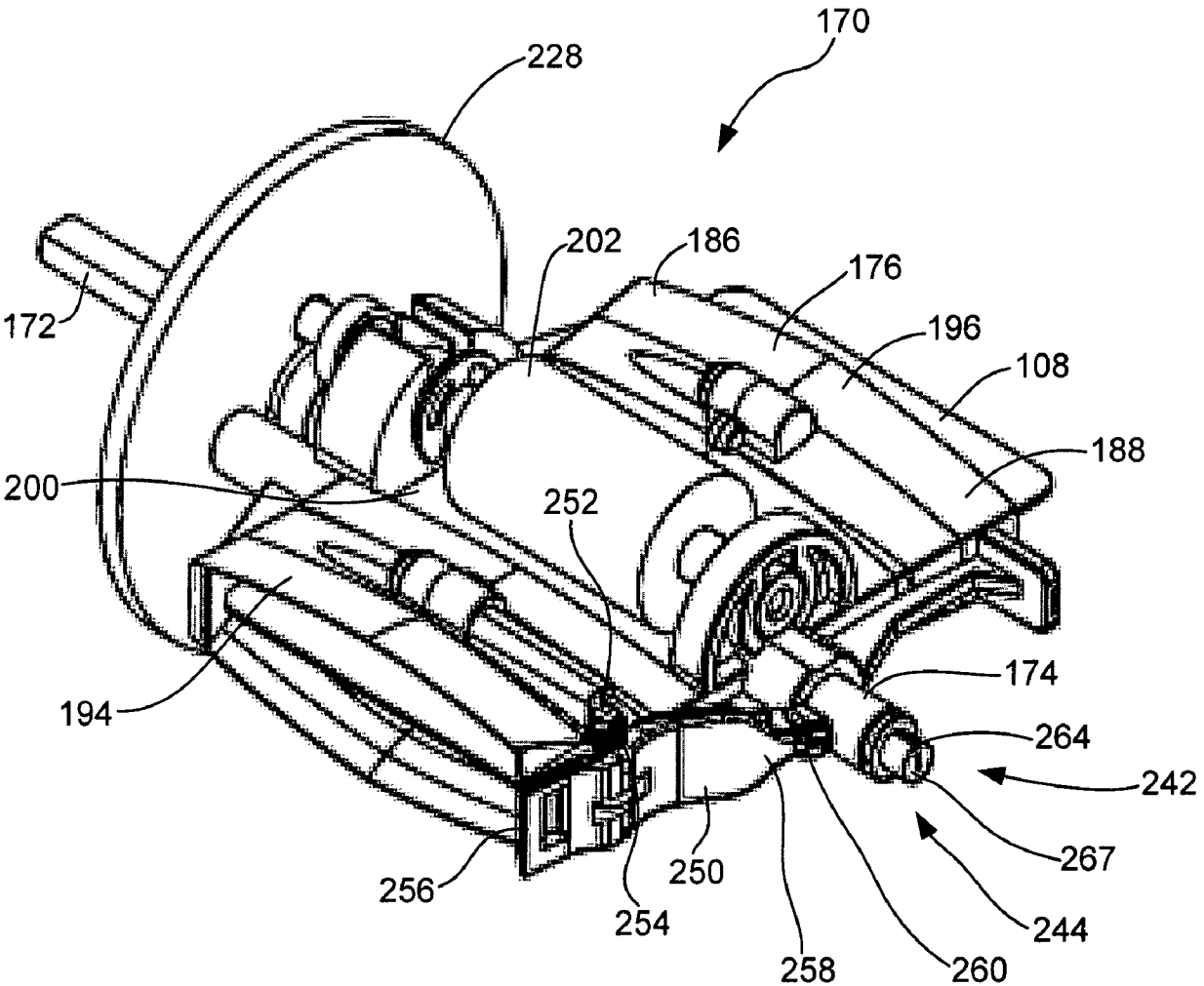
FIG. 5 is a perspective view of a substrate rotator in accordance with embodiments of the invention.
Figure 6:
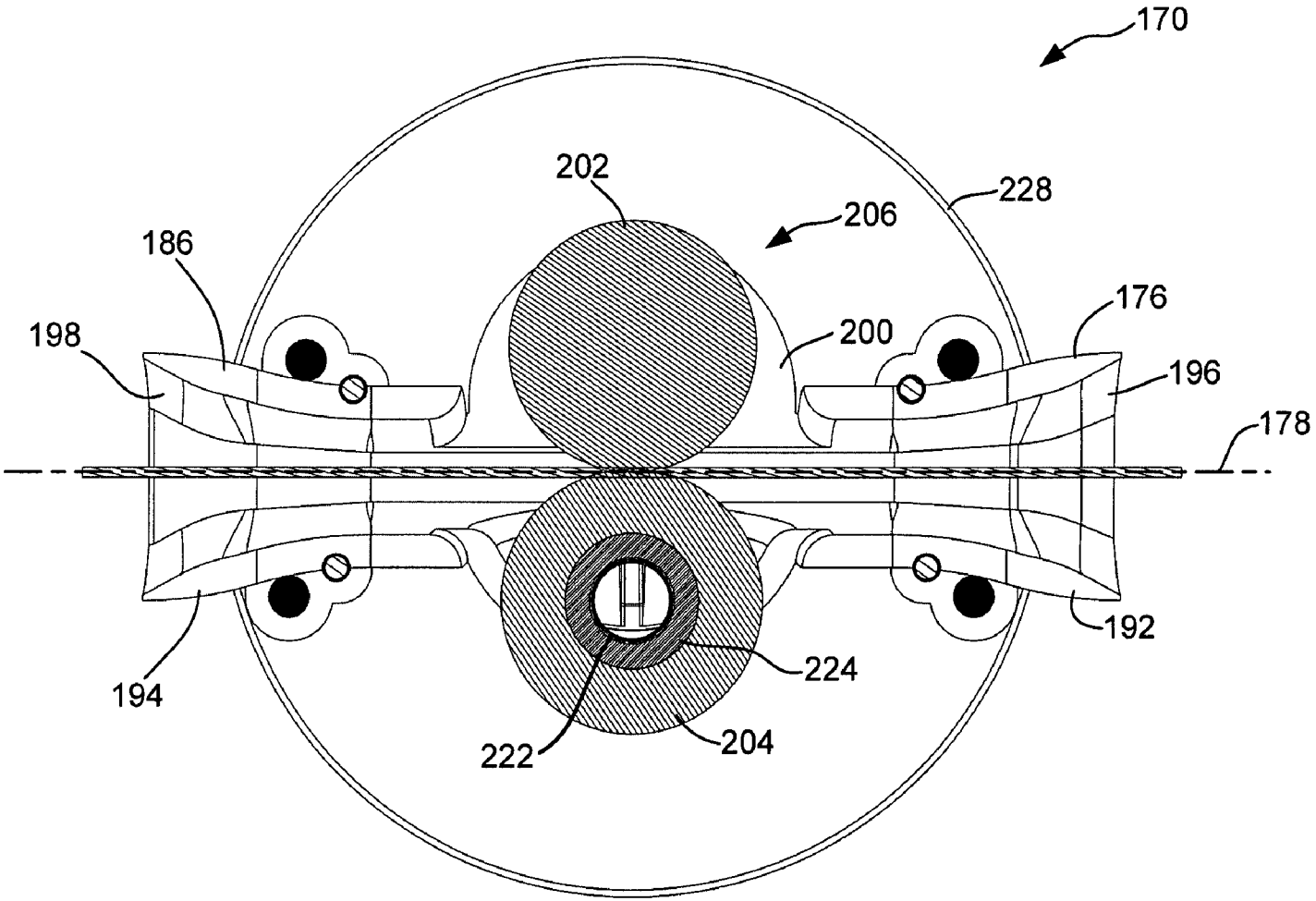
FIG. 6 is a side cross-sectional view of a substrate rotator in accordance with embodiments of the invention.
Figure 7:
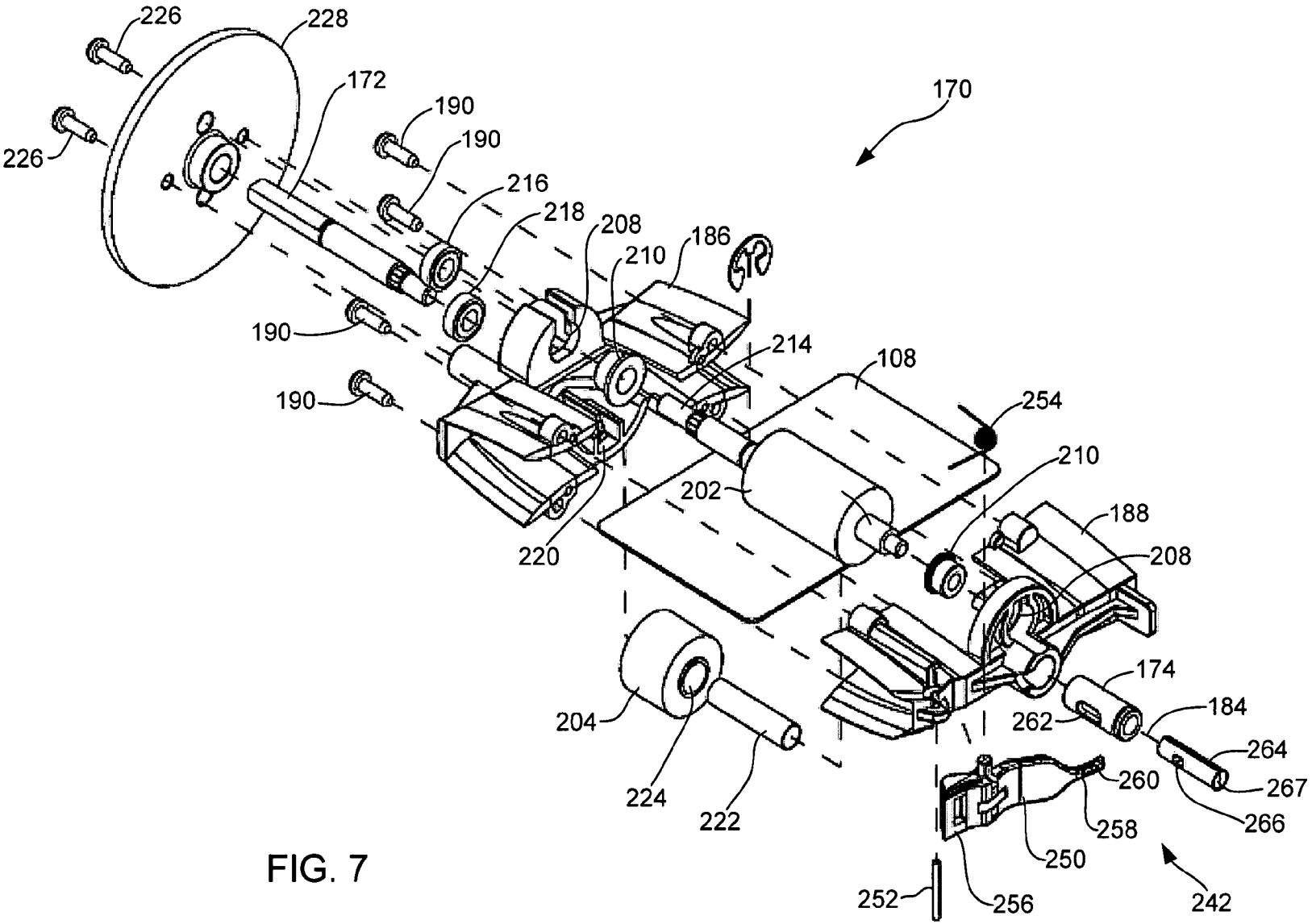
FIG. 7 is an exploded perspective view of a substrate rotator in accordance with embodiments of the invention.
Figure 8:
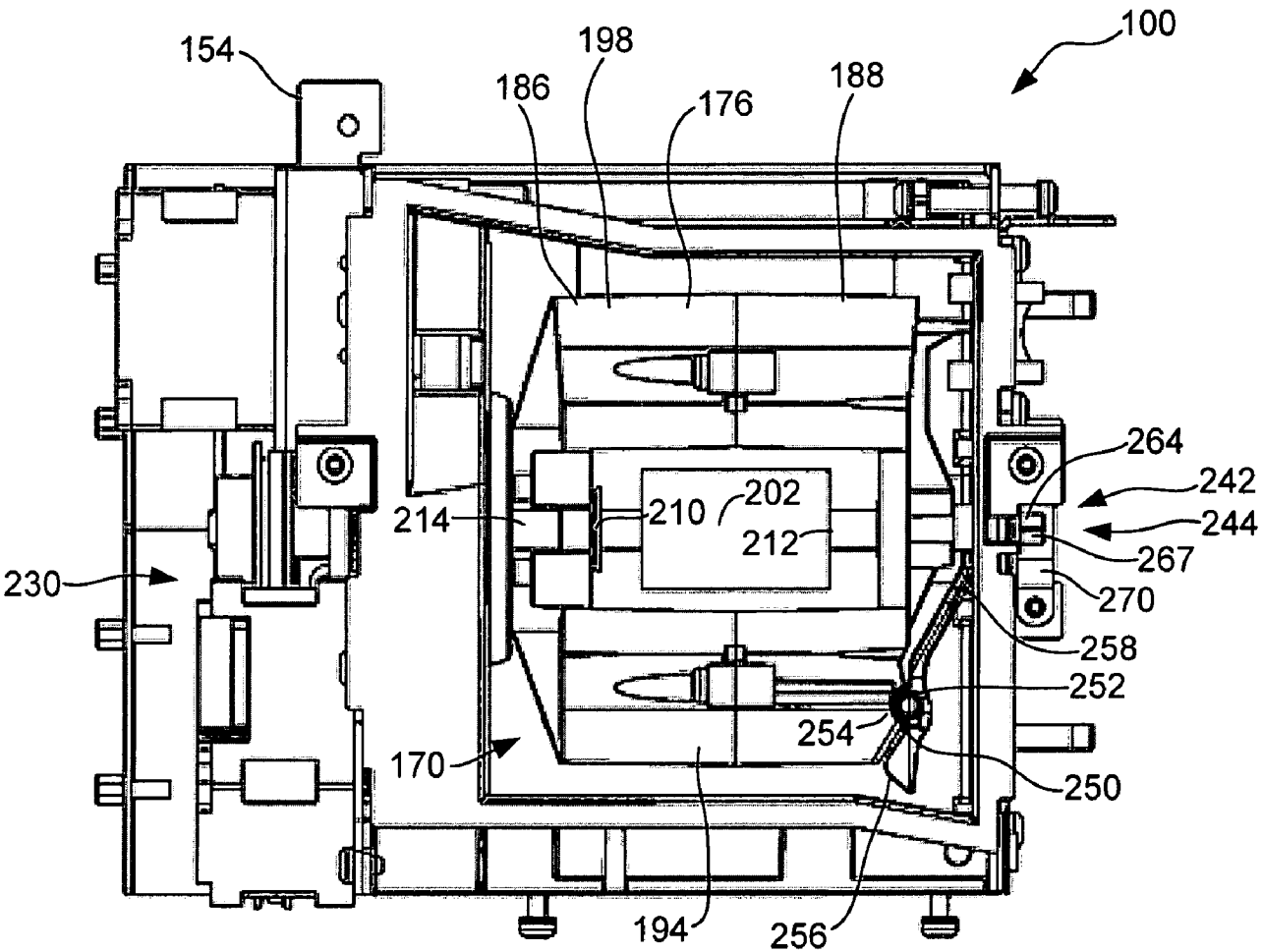
FIGS. 8 and 9 are top plan views of a credential substrate processing module in accordance with embodiments of the invention.
Figure 9:
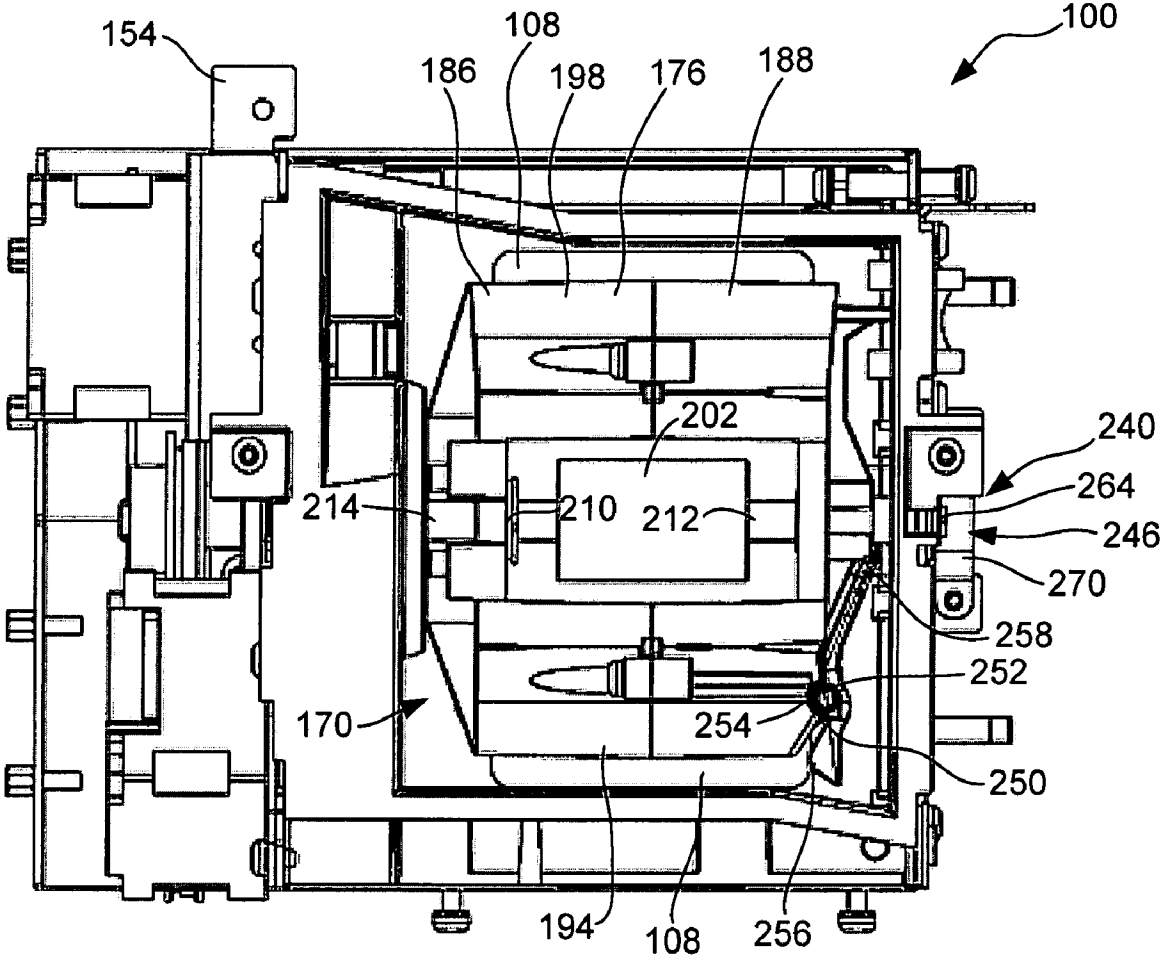

Perspective, side and exploded perspective views of the substrate rotator 170 in accordance with embodiments of the invention are respectively shown in FIGS. 5-7. FIGS. 8 and 9 are top plan views of the module 100 that illustrate features of the rotator 170.

One embodiment of the substrate rotator 170 includes stub shafts 172 and 174 connected to a substrate support 176. The substrate support 176 defines a substrate support plane 178 (FIG. 6), in which the substrate 108 is supported and fed by the rotator 170. The stub shafts 172 and 174 are respectively supported between opposing side walls 180 and 182 shown in FIG. 3. The substrate support 176 rotates about a central axis 184 (FIG. 4) that is aligned with the stub shafts 172 and 174. In accordance with one embodiment of the invention, the central axis 184 extends through the substrate 108 supported by the substrate support 176. Accordingly, the substrate support plane 178 and any substrate 108 held within the substrate support 176 are rotated about the central axis 184 as the substrate support 176 is rotated.

One embodiment of the substrate support 176 includes first and second sections 186 and 188 that are joined together by screws 190. The substrate support also includes front and rear substrate guides 192 and 194 having flared ports 196 and 198, respectively, through which substrates 108 are received and discharged. A central opening 200 in the substrate support 176 accommodates a drive roller 202 and an idler pinch roller 204, respectively, which form a substrate feeder 206.

The first and second sections 186 and 188 of the substrate support 176 each include a drive roller support 208 that is configured to receive a bearing or bushing 210, for rotatable support of a shaft 212 of the drive roller 202. One end 214 of the shaft 212 extends through the support 208 of the first section 186 and is attached to a gear 216 (e.g., a spur gear) that engages a gear 218, which is driven by a motor (not shown) driving stub shaft 172.

The first and second sections 186 and 188 of the substrate support 176 each include a pinch roller support 220 that is configured to receive ends of a spring member 222, which extends through a hub 224 of the pinch roller 204. The pinch roller 204 is configured to rotate about the spring member 222 and is biased by the spring member 222 toward the drive roller 202 for contact engagement therewith. Accordingly, the pinch roller 204 is configured for rotation and movement toward and away from the drive roller 202.

As a substrate 108 is received between the drive roller 202 and the pinch roller 204, the pinch roller 204 pinches the substrate 108 against the drive roller 202 and the drive roller 202 either holds the substrate 108 in the substrate support plane 178, or is driven to feed the substrate 108 in the desired direction along the substrate support plane 178 while the pinch roller 204 responsively rotates in accordance with the direction the substrate 108 is driven. The pinching force applied by the pinch roller 204 to the substrate 108 is preferably sufficient to hold or clamp the substrate 108 in place.

The first section 186 of the substrate support 176 is attached with screws 226 or other means to a support gear 228, through which an end of the stub shaft 172 extends. The support gear 228 is driven by a motor for rotation about the stub shaft 172. The rotation of the support gear 220 rotates the substrate support 176 and a substrate 108 received between the drive and pinch rollers 202 and 204, about the central axis 184 that is co-axially aligned with the central axis 184 of the stub shafts 172 and 174, and is aligned with the central plane of the substrate 108 supported between the drive and pinch rollers 202 and 204.

Figure 3:
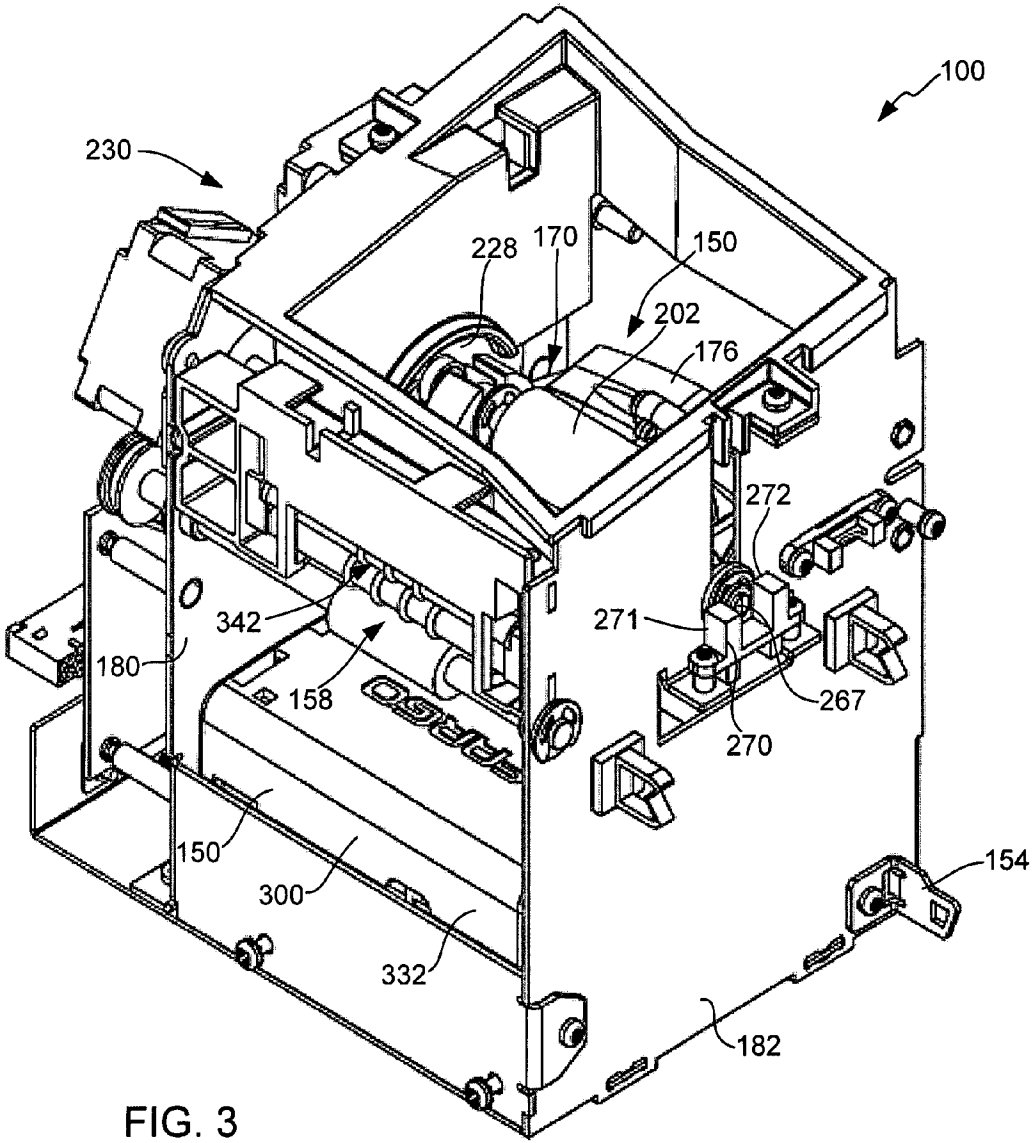
FIG. 3 is a perspective view of a credential substrate processing module with a housing and cover removed in accordance with embodiments of the invention.

The stub shaft 172 and the gear support 228 are driven by motors through an appropriate gear arrangement in a gear housing 230 (FIG. 3). The stub shaft 172 is received within the gear housing 230 and serves to drive the gear 218 to drive the gear 216, which in turn drives the shaft 212 of the drive roller 202. The stub shaft 172 is preferably driven by a stepper motor, or other suitable motor.

A stepper motor (not shown) is also preferably used for driving the gear support 228 in a suitable manner to rotate the attached substrate support 176 about the central axis 184. The stepper motor and the motor driving the stub shaft 172 are controlled by the controller 162 to rotate the substrate support 176 and the substrate support plane 178 in any desired angular position and to feed the substrate 108 relative to the substrate support 176 along the substrate support plane 178. In accordance with one embodiment of the invention, the drive roller 202 is rotated in the opposite direction of the rotation of the gear support 228 to maintain the substrate 108 in the center of the substrate support 176. For example, if the gear support 228 is rotated in a counterclockwise direction, the controller 162 drives the drive roller 202 in a clockwise direction to prevent the substrate 108 from moving relative to the substrate support 176. If the drive roller 202 was not driven in this manner, the gear 216 would roll over the gear 218 causing the drive roller 202 to rotate in the same direction (clockwise or counterclockwise) of the support gear 228 thereby moving the substrate 108 relative to the substrate support 176.

One advantage to maintaining the substrate 108 substantially in the center of the substrate support 176 during rotating operations, is that it reduces the space required to perform the substrate rotating operation. As a result, the size of the module 100 can be formed smaller than would be possible if the substrate 108 moved relative to the substrate support 176 during rotating operations.

Substrate Sensor

One embodiment of the rotator 170 includes a substrate sensor 240 that detects the presence or absence of a substrate 108 at a predetermined location relative to the substrate support 176. One embodiment of the substrate sensor 240 does not utilize an electrical connection, such as a slip ring connection, between the rotating substrate support 176 and the non-rotating controller 162. Rather, the substrate sensor 240 of the present invention comprises a mechanical switch 242 mounted to the substrate support 176 that is moved from a first position 244 (FIGS. 5 and 8) when the substrate 108 is not fully loaded into the substrate support 176 or is absent from the predetermined location, to a second position 246 (FIG. 9) when a substrate 108 is loaded into the substrate support 176 or is present in the predetermined location. Preferably, the switch 242 is moved to the second position 246 when the substrate 108 is fully seated in the desired position (e.g., centered) in the substrate support 176 between the driver and pinch rollers 202 and 204.

One embodiment of the switch 242 of the substrate sensor 240 includes a lever arm 250 that pivots about a pin 252 mounted to the second section 188 of the substrate support 176. A spring 254, or other suitable biasing member biases the lever 250 toward the first position 244, in which an end 256 protrudes into the substrate path or the support plane 178 and an opposing end 258 is displaced away from the second section 188 of the substrate support 176 along the central axis 184. The end 258 includes a protrusion 260 that extends through an opening 262 in the stub shaft 174 and is received by a pin trigger 264 in a notch 266. In accordance with one embodiment of the invention, the pin trigger 264 is coaxial with the central axis 184. The stub shaft 174 and the pin trigger 264 are configured to rotate with the substrate support 176 about the central axis 184. When the lever arm 250 is in the first position 244, a portion 267 of the pin trigger 264 extends outside of the stub shaft 174, as shown in FIGS. 5 and 8.

A pin sensor 270 (FIG. 3) detects the first or second position of the switch 242 and provides a signal indicating such to the module controller 162 or the CMD controller 116. In accordance with one embodiment of the invention, the pin sensor 270 is a slotted optical sensor that includes a receiver 271 and an emitter 272, between which the portion 267 of the pin trigger 264 extends when the lever arm 250 is in the first position 244, as shown in FIGS. 5 and 8. The pin sensor 270 provides an output signal to the module controller 162 or the CMD controller 116, that indicates the absence of the portion 167 of the pin trigger 264 from between the emitter and receiver of the pin sensor 270 thereby indicating the absence of a substrate 108 from the predetermined location of the substrate support 176.

As the substrate 108 is loaded into the substrate support 176 from, for example, the substrate output 112 of the CMD 102, the substrate 108 engages the end 256 of the lever 250 and moves the end 256 out of the substrate path as the substrate 108 is driven by the drive roller 202 to move the lever 250 from the first position 244 toward the second position 246 (FIG. 9). The movement of the end 256 of the lever 250 causes the opposing end 258 and the connected trigger pin 264 to move along the central axis 184 such that the portion 267 of the pin trigger 264 is retracted within the shaft 174 and withdrawn from the pin sensor 270.

The output signal from the pin sensor 270 can then indicate that the switch 242 is in the second position 246 and that the substrate 108 is loaded into the substrate support 176 at the predetermined location of the substrate support 176. Once the module controller 162 receives the signal from the pin sensor 240 that the substrate 108 is loaded into the substrate support 176, rotating operations are allowed to commence.

The rotator 170 is preferably configured to align the substrate support plane 178 at any desired angle. Preferably, the rotator 170 is configured to rotate the substrate support 176 and the corresponding support plane 178 about the central axis 184 to a plurality of indexed or predefined angular positions, such as those shown in FIGS. 4 and 10-14.

One such indexed angular position is a substrate receiving position, indicated by the substrate support plane 178A (FIGS. 4 and 12), in which the substrate support plane 178 is aligned such that a substrate 108 can be transferred between the rotator 170 and the output 112 of the CMD 102. A substrate inversion is performed by the rotator 170 by rotating the substrate support 176 180° such that the substrate support plane 178 is substantially realigned with the substrate receiving position 178A. The substrate 108 can then be fed back to the output 112 of the CMD 102 through the input 152 for additional processing. Other indexed angular positions will be discussed below.

Embodiments of the present invention include the use of the above-described substrate sensor with other substrate rotators, including substrate rotators that are not components of credential manufacturing device modules.

Data Encoder(s)

In accordance with another embodiment of the module 100, the substrate processing component 150 includes one or more data encoders 300, shown in FIG. 4, for encoding data to the substrate 108. In accordance with another embodiment of the invention, the module 100 includes one or more data encoders 300 and the rotator 170.

FIGS. 10-14 are simplified side cross-sectional views of embodiments of the module 100 connected to the CMD 102 (partial view). The data encoders 300 can each be located in one of a plurality of bays in the housing of the module, such as bay 302 or bay 304. Each data encoder 300 can include a data writer 306 configured to write data to a memory chip, a bar code, or other component of the substrate 108, and a data reader 308 configured to read data from the substrate 108, in accordance with known methods.

Figure 10:
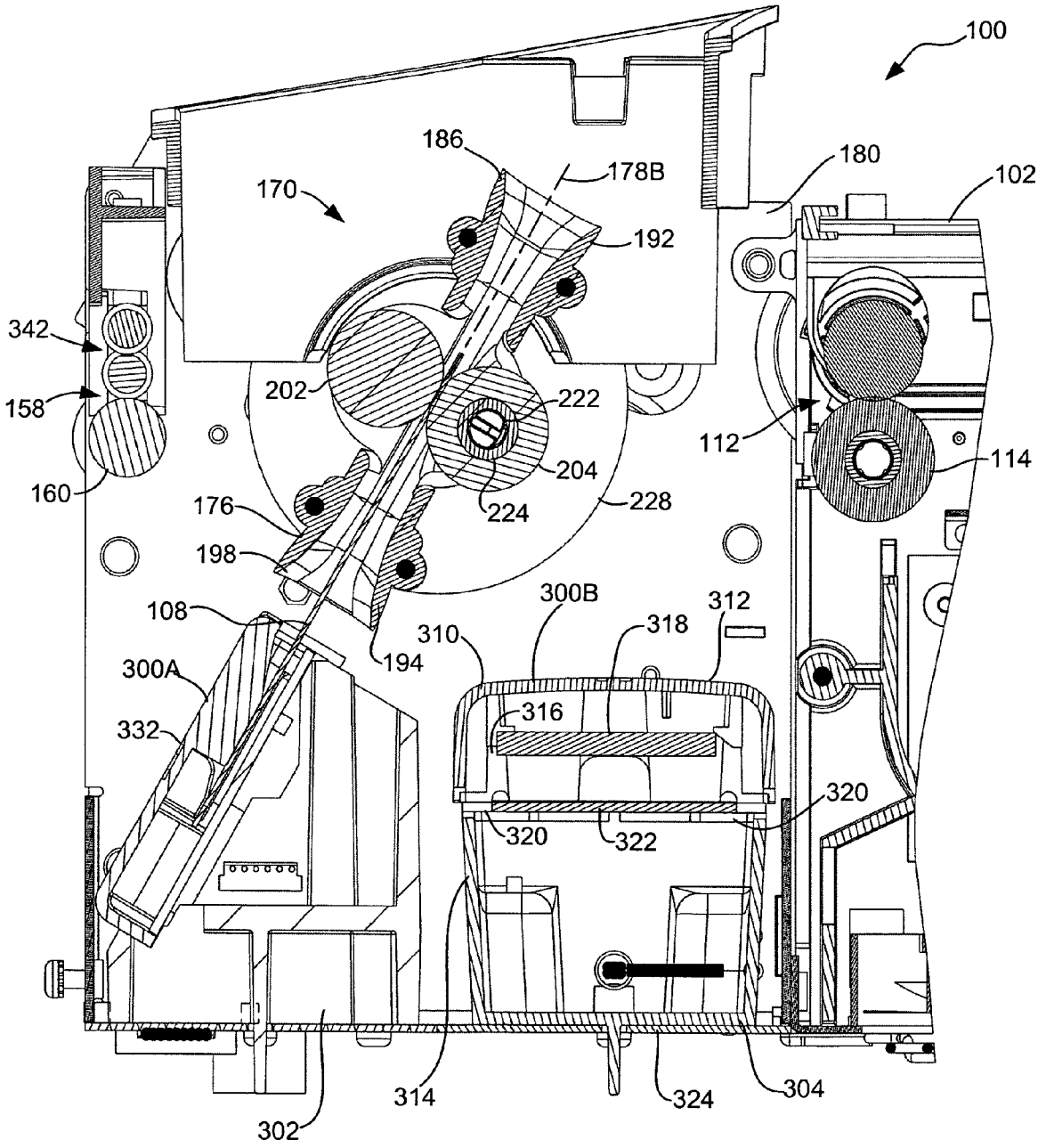
FIGS. 10-14 are side cross-sectional views of the module in accordance with embodiments of the invention.

The encoders 300 can be either a contact encoder 300A configured to encode the substrate 108 through direct contact, or a proximity encoder 300B configured to perform proximity or radio frequency encoding of the substrate 108 as shown in FIG. 10. The encoding can be conducted in accordance with a standardized method such as, for example, HID®, iCLASS™, MIFARE, Legic, or other encoding method.

One embodiment of the encoders 300 includes a housing 310 that is configured to contain the circuit boards and components of multiple types of proximity encoders and readers. For example, one housing 310 can contain an HID® iCLASS proximity encoder and reader boards, MIFARE proximity encoder and reader boards, or Legic proximity encoder and reader boards. Such a housing 310 provides a cost savings since there is no need to produce multiple housing types. Additionally, the single standardized housing 310 simplifies the installation of the encoders 300 in the module 100.

One embodiment of the housing 310, shown in FIG. 10, includes a bottom portion 312 and a top portion 314 that is configured to snap-fit to the bottom portion 312. Shoulder portions within the housing 310 provide support for the proximity encoding and reading boards. In accordance with one embodiment of the invention, the housing 310 includes multiple shoulder portions to accommodate the different types of boards in different locations within the housing 310. For example, shoulder portions 316 can be positioned and the interior of the housing 310 can be shaped, to receive an iCLASS board 318, whereas shoulder portions 320 can be positioned and the interior of the housing 310 can be shaped, to receive a MIFARE board 322, as shown in FIG. 10.

In accordance with another embodiment of the invention, the housing 310 includes a base plate 324. The base plate 324 covers an opening of the bay 304 of the module 100 when the encoder 300 is installed.

Cables, depicted schematically in FIG. 4, connect the encoder modules 300 to the module controller 162 of the module 100 to provide a communication link therewith. Power can also be supplied through the cables. In accordance with one embodiment of the invention, the cables connecting the encoder modules 300 to the module controller 162 are multi-pin (e.g., 8-pin) cables. Identification of the particular encoder 300 that is installed is automatically determined based upon the pins that are active/inactive in the cable. This can be accomplished using a look-up table contained in the memory 166, or other suitable method. As a result, one embodiment of the module 100 includes a "plug and play"

feature that quickly identifies the setup of the module 100 for the module controller 162, the CMD controller 116 and/or the substrate producing application 122.

Module Operation

Instructions regarding the rotating of a substrate 108 that is loaded into the substrate support 176 of the rotator 170 are generally provided by the substrate processing job generated by the substrate producing application or driver software 122. The substrate processing job can include, for example, printing instructions, laminating instructions, encoding instructions, rotating instructions, and other substrate processing instructions.

Initially, the rotator 170 is positioned in a receiving position indicated by substrate support plane 178A (FIGS. 4 and 12), in which the substrate support 176 is in substrate handoff alignment with the substrate output 112 of the CMD 102. In other words, the substrate support plane 178A is generally horizontally aligned with the substrate path that a substrate 108 follows when discharge through the substrate output 112, as shown in FIG. 4.

One embodiment of the module 100 includes a substrate sensor 330 (FIGS. 2 and 4) at the substrate input 152, such as a slotted optical sensor, that provides an indicator to the module controller 162 that a substrate 108 is ready to be received in the substrate support 176. The substrate 108 is then received by the rotator 170 by driving the substrate 108 into the substrate support 176 using the drive roller 202 until the substrate sensor 240 indicates receipt of the substrate 108 (e.g., the switch 242 moves from the first position to the second position).

Substrate Inversion

Once the substrate 108 is received within the substrate support 176 of the rotator 170, rotating operations can be performed on the substrate 108. For instance, a 180° rotation, or inversion, of the substrate 108 is performed by rotating the gear support 228 180°. Preferably, the gear support 228 is indexed to provide accurate angular substrate positioning. The substrate 108 is then discharged by driving it past the end 256 of the lever 250 of the switch 242 where it is detected by the substrate sensor 330 and received at the substrate output 112 of the CMD 102. Additional processing of the substrate 108, such as printing, can then be carried out on the substrate 108.

Substrate Encoding

Figure 11:
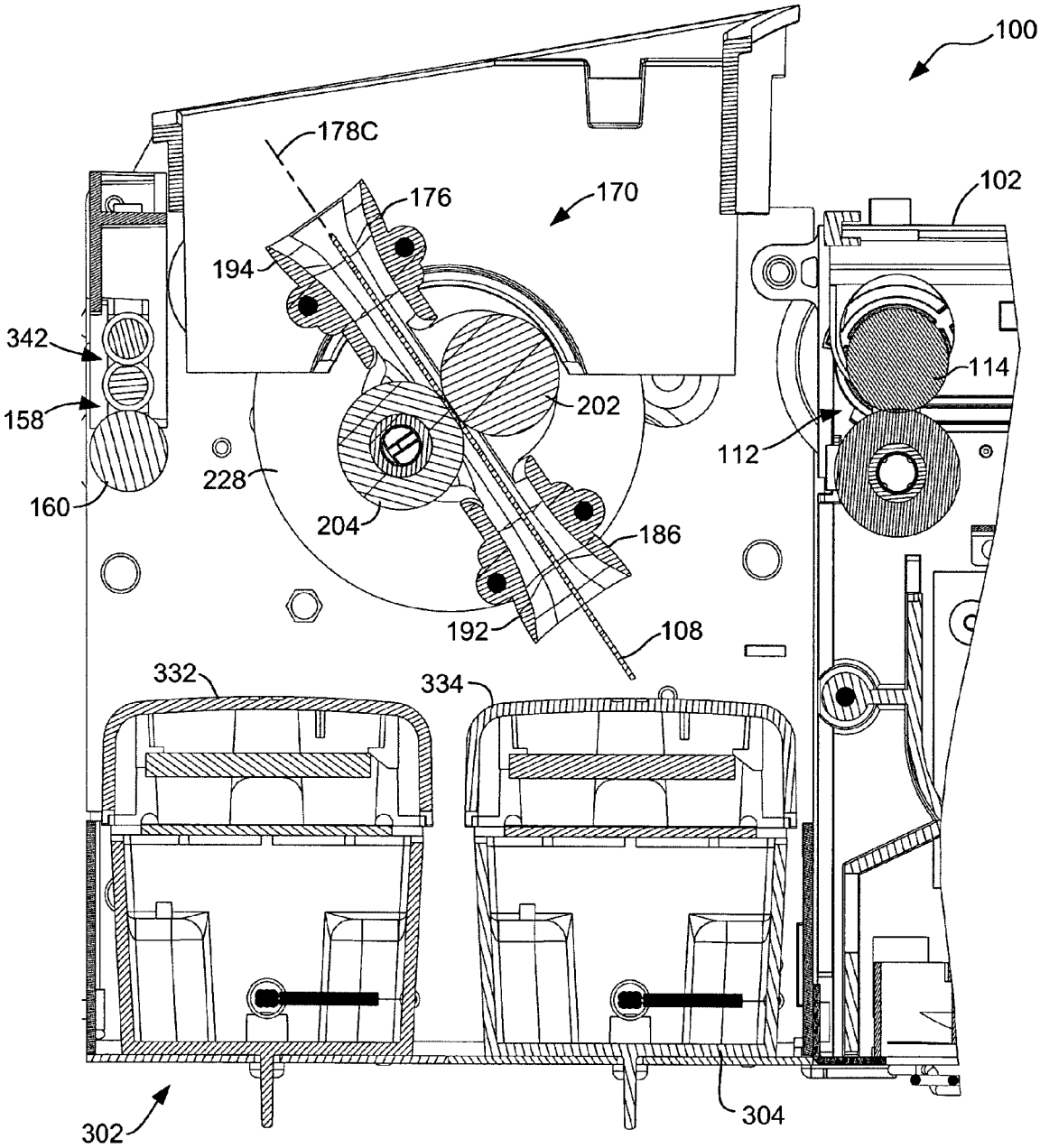
Figure 12:
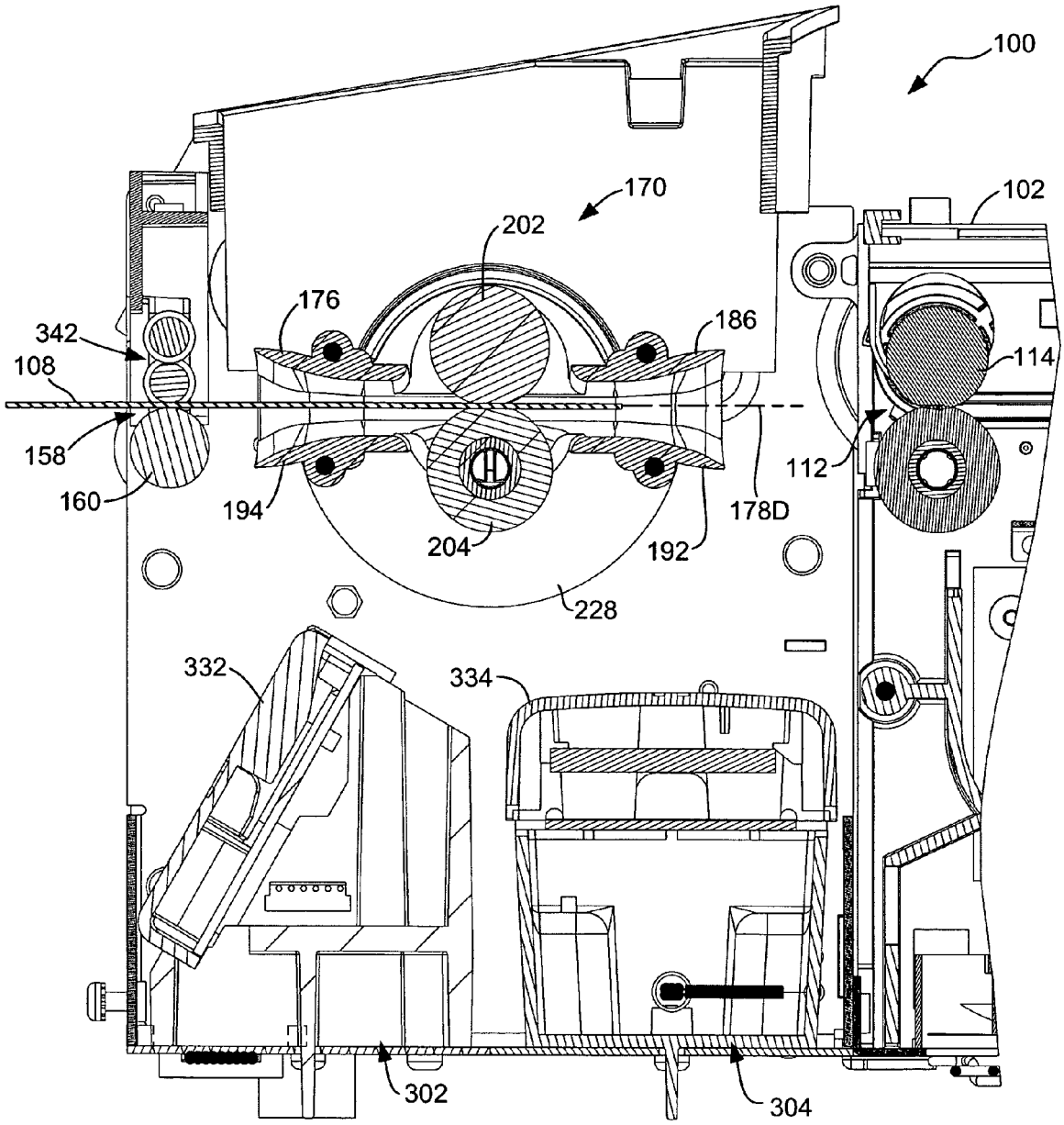
Figure 13:
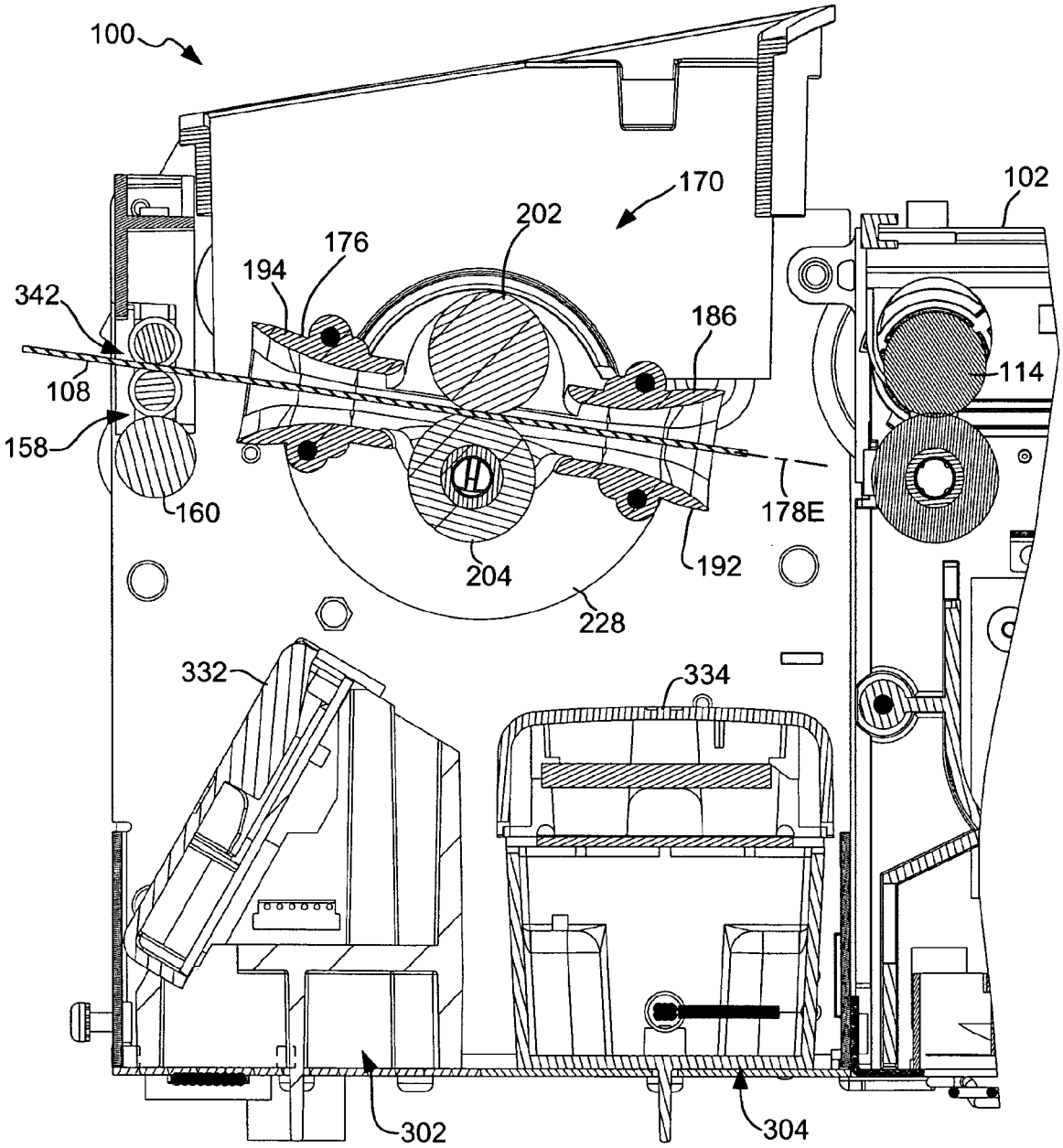
Figure 14:
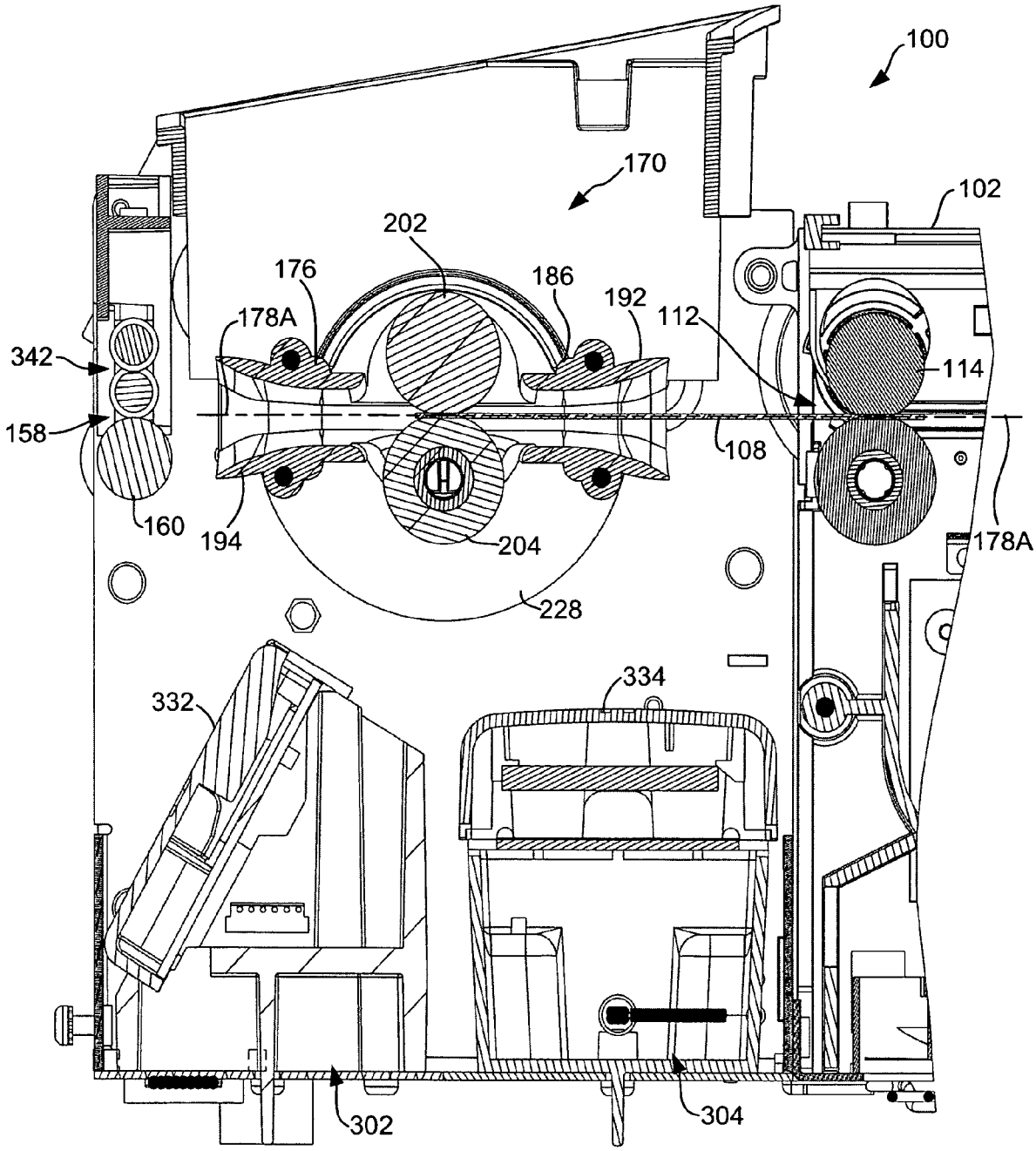

Additionally, the rotator 170 can be used to direct the substrate 108 toward one or both of the encoding modules 300 to perform encoding operations on the substrate 108. Accordingly, rotator 270 can rotate the substrate support 176 to a first encoding position, indicated by substrate support plane 178B (FIGS. 4 and 10), to align the substrate support 176 and the substrate 108 for encoding with the encoder 332. Likewise the rotator 170 can rotate the substrate support 176 in alignment with a second encoding position, indicated by substrate support plane 178C (FIGS. 4 and 11), for encoding a substrate 108 with the encoder 334. After the substrate 108 is rotated to the desired angular position corresponding to the encoder 300 to be used, the substrate 108 can be fed toward the encoder 300 by the feeder 206, if necessary, to position the substrate 108 for encoding. FIG. 10 illustrates the rotation and insertion of the substrate 108 within the contact encoder 300A for contact smart chip encoding. FIG. 11 illustrates the rotation of the substrate 108 and the feeding of the substrate 108 toward the proximity encoder 300B for a wireless encoding of the smart chip of the substrate 108.

Substrate Discharging Options

In accordance with one embodiment of the invention, the substrate support 176 of the rotator 170 includes different indexed angular positions for discharging correctly processed substrates 108 and incorrectly or incompletely processed substrates 108. When the substrate has been correctly processed, the substrate support 176 is rotated to a substrate collection output position, indicated by substrate support plane 178D (FIGS. 4 and 12), which aligns the substrate with the substrate collection output 158. In accordance with one embodiment of the invention, the substrate collection output position 178D is coplanar with the substrate receiving position 178A, as shown in FIG. 4. The substrate 108 can then be fed or discharged through the substrate collection output 158 for collection in an optional hopper (FIG. 4) 340.

When the substrate 108 has not been correctly processed, the substrate support 176 can be angularly aligned with a substrate reject output position, indicated by substrate support plane 178E (FIGS. 4 and 13), which is aligned with a substrate reject output 342. The substrate 108 can then be fed or discharge through the substrate reject output 342 for collection in an optional reject tray or hopper 344, as shown in FIG. 4.

Substrate Antenna Detection

Substrates that are configured for proximity encoding of their smart chips include an antenna that receives the encoding signals from the data writer 306 and an antenna that transmits signals for reading of the smart chip by the corresponding proximity reader 308 of the encoder 300. It is desirable to position the antenna of the substrate 108 as close as possible to the proximity encoder module 300 to ensure proper encoding of the smart chip. Some substrates have antennas that are positioned more toward one end of the substrate than the other. As a result, the end of the substrate that is fed toward the encoder 300 (FIG. 11) by the rotator 170 may not be the end that contains the antenna, which may result in a failed encoding attempt. One embodiment of the invention includes commands that can be used to ensure that the substrate 108 is in the best position for encoding.

When the antenna position for the substrate and the position the substrate will be in when loaded into the system 104, such as in a substrate supply 128 (FIG. 2), is known in advance, instructions can be provided to the controller 162 to orient the substrate 108 such that the antenna is as close as possible to the proximity substrate encoder 300. Thus, the substrate 108 can be flipped, if necessary, prior to feeding it toward the encoder 300 to position the antenna in the optimum location.

Another embodiment of the invention operates to ensure that the best attempt to encode the substrate is made even when the specific substrate configuration is unknown. In accordance with this embodiment of the invention, following an encoding operation where an end of the substrate 108 is positioned adjacent the encoder module 300 (FIG. 11), the smart chip of the substrate 108 is read by the proximity substrate reader of the encoder 300. If the encoding operation fails (i.e., the smart chip was not properly encoded), the substrate 108 is reloaded into the rotator 170, rotated 180° and fed back toward the encoding module 300 for a second encoding attempt. Hopefully, the antenna of the substrate 108 will be in a better position on the second attempt for a successful encoding operation. Thus, it is ensured that the best attempt to encode the substrate has been made.

Substrate Check Initialization Routine

Another embodiment of the invention relates to an initialization routine that operates to check that the system 104 is ready for substrate processing. In general, prior to beginning substrate processing, particularly when power to the system 104 is activated from an off state, it is desirable to perform a check to determine whether a substrate remains within the CMD 102 or the module 100.

In accordance with one embodiment of the invention, a check is made to determine whether a substrate 108 is loaded in the module 100, by first checking the substrate sensor 240 to determine whether it indicates the presence or absence of a substrate 108 in the substrate support 176. If a substrate 108 is detected, the rotator 170 preferably discharges the substrate 108 through the output 158 or 342.

If no substrate 108 is detected, the drive roller 202 is activated to rotate in a direction that would pull any substrate 108 that may be held between the drive roller 202 and the pinch roller 204 into the substrate support 176 for detection by the substrate sensor 240. A substrate 108 may be held between the drive and pinch rollers 202 and 204 when, for example, power to the system 104 was lost or turned off while the substrate 108 was being encoded by one of the encoder modules 300. After the drive roller 202 activation is completed, a check is made to determine whether the substrate sensor 240 detects a substrate 108 in the substrate support 176. If a substrate 108 is detected, the substrate 108 is preferably discharged through the reject output 164. If no substrate 108 is detected, it can be assumed that the module 100 is clear of substrates 108 and substrate processing operations can commence on a new substrate provided that similar operations in the CMD 102 do not reveal the presence of a substrate therein.

Although the present invention has been described with reference to preferred embodiments, workers skilled in the art will recognize that changes may be made in form and detail without departing from the spirit and scope of the invention. For example, it should be understood that the present invention includes the embodiments described above taken individually and in combination with one or more of the other embodiments of the invention.

What is claimed is:

1. A credential substrate rotator comprising:

a substrate support configured to support a substrate in a substrate support plane and rotate the substrate support plane about a central axis, which extends through the substrate support plane;

a substrate feeder configured to feed a substrate along the substrate support plane; and a substrate sensor including a substrate position indicator having a first position indicative of an absence of a substrate from a predetermined location of the substrate support, and a second position indicative of a presence of a substrate in the predetermined location of the substrate support, wherein the first and second positions are displaced from each other in the direction of the central axis.

2. The credential substrate rotator of claim 1, wherein:

the substrate rotator further comprises a shaft coaxial with the central axis and connected to the substrate support; and the substrate position indicator comprises a pin trigger received within the shaft and coaxial with the central axis.

3. The credential substrate rotator of claim 2, wherein a portion of the pin trigger is extended beyond the shaft along the central axis when the substrate position indicator is in the first position, and the portion of the pin trigger is retracted within the shaft when the substrate position indicator is in the second position.

4. The credential substrate rotator of claim 1, wherein the substrate sensor includes a lever arm attached to the substrate support and including first and second ends, the second end connected to the substrate position indicator, the lever arm configured to pivot between first and second positions respectively corresponding to the first and second positions of the substrate position indicator.

5. The credential substrate rotator of claim 4, wherein the lever arm is biased toward the first position, in which the first end is positioned adjacent to the predetermined location of the substrate support.

6. The credential substrate rotator of claim 1 including position sensor configured to detect one of the first and second positions of the substrate position indicator.

7. The credential substrate rotator of claim 1 including a housing configured to attach to a stand-alone credential manufacturing device.

8. The credential substrate rotator of claim 1, wherein the substrate support includes indexed angular positions including a substrate receiving position, in which the substrate support is positioned to receive a substrate fed from an adjoining credential manufacturing device and a substrate collection output position, in which the substrate support plane is aligned with a substrate collection output.

9. The credential substrate rotator of claim 8, wherein the indexed angular positions of the substrate support include a substrate reject output position, in which the substrate support plane is aligned with a substrate reject output.

10. The credential substrate rotator of claim 8, wherein:

the indexed angular positions of the substrate support include a first encoding position; and the credential substrate rotator including a first data encoder configured to encode data to a substrate presented by the substrate feeder when the substrate support is in the first encoding position.

11. The rotator of claim 10, wherein:

the indexed angular positions of the substrate support include a second encoding position; and the credential substrate rotator includes a second data encoder configured to encode data to a substrate presented by the substrate feeder when the substrate support is in the second encoding position.

12. A credential substrate processing module configured to couple in substrate hand-off alignment to a stand-alone credential manufacturing device including the credential substrate rotator of claim 1.

13. A credential substrate processing module configured to couple in substrate hand-off alignment to a stand-alone credential manufacturing device, the module comprising:

a credential substrate rotator including:

a substrate support configured to support a substrate in a substrate support plane and rotate the substrate support plane about a central axis, which extends through the substrate support plane, the substrate support having indexed angular positions including a substrate receiving position, in which the substrate support is positioned to receive a substrate fed from an adjoining stand-alone credential manufacturing device, and a first encoding position;

a substrate feeder configured to feed a substrate along the substrate support plane; and a substrate sensor including a substrate position indicator coaxially aligned with the central axis and having a first position indicative of an absence of a substrate from a predetermined location of the substrate support, and a second position indicative of a presence of a substrate in the predetermined location of the substrate support, wherein the first and second positions are displaced from each other in the direction of the central axis;

a first data encoder configured to encode data to a substrate presented by the substrate rotator when the substrate support is oriented with the first encoding position; and a module controller configured to control the substrate rotator and the first encoder module, and communicate with a controller of the stand-alone credential manufacturing device.

14. The module of claim 13, wherein the credential substrate rotator further comprises:

a shaft coaxial with the central axis and connected to the substrate support;

wherein the substrate position indicator comprises a pin trigger received within the shaft and coaxial with the central axis.

15. The module of claim 14, wherein a portion of the pin trigger is extended beyond the shaft along the central axis when the substrate position indicator is in the first position, and a portion of the pin trigger is retracted within the shaft when the substrate position indicator is in the second position.

16. The module of claim 13, wherein the substrate sensor includes a lever arm attached to the substrate support and including first and second ends, the second end connected to the substrate position indicator, wherein the lever arm is configured to pivot between first and second positions respectively corresponding to the first and second positions of the substrate position indicator.

17. The module of claim 16, wherein the lever arm is biased toward the first position, in which the first end is positioned adjacent to the predetermined location of the substrate support.

18. The module of claim 14 including a pin trigger sensor configured to detect one of the first and second positions of the pin trigger.

19. The module of claim 13, wherein:

the indexed angular positions of the substrate support include a second encoding position; and the module includes a second data encoder configured to encode data to substrate presented by the substrate rotator when the substrate support is oriented with the second encoding position.

20. The module of claim 13 including a substrate collection output and a substrate reject output; wherein the indexed angular positions of the substrate support include a substrate collection output position, in which the substrate support plane is aligned with the substrate collection output, and a substrate reject output position, in which the substrate support plane is aligned with the substrate reject output.

21. The module of claim 13 including a cable connecting the module controller to the first data encoder, wherein the first data encoder is configured to indicate a configuration setting through the cable.

22. The credential substrate rotator of claim 1, wherein the first and second positions of the substrate position indicator are displaced from each other along the central axis.

23. The credential substrate rotator of claim 13, wherein the first and second positions of the substrate position indicator are displaced from each other along the central axis.

24. A credential substrate rotator comprising:

a shaft configured to rotate about a central axis;

a substrate support coupled to the shaft, the substrate support configured to support a substrate in a substrate support plane and rotate the substrate support plane about the central axis;

a substrate feeder configured to feed a substrate along the substrate support plane; and a substrate sensor including a substrate position indicator coaxially aligned with the central axis and configured to move along the central axis between first and second positions, wherein the first position is indicative of an absence of a substrate from a predetermined location of the substrate support, and the second position is indicative of a presence of a substrate in the predetermined location of the substrate support.

25. The credential substrate rotator of claim 24, wherein the substrate position indicator is received within the shaft.

* * * * *